US007830341B2

(12) United States Patent
Ooka et al.

(10) Patent No.: US 7,830,341 B2
(45) Date of Patent: Nov. 9, 2010

(54) ORGANIC ELECTROLUMINESCENCE DISPLAY DEVICE

(75) Inventors: Hiroshi Ooka, Mobara (JP); Hirotsugu Sakamoto, Chiba (JP); Masamitsu Furuie, Mobara (JP); Takeshi Ookawara, Mobara (JP)

(73) Assignee: Hitachi Displays, Ltd., Chiba-Ken (JP)

( * ) Notice: Subject to any disclaimer, the term of this patent is extended or adjusted under 35 U.S.C. 154(b) by 856 days.

(21) Appl. No.: 11/733,235

(22) Filed: Apr. 10, 2007

(65) Prior Publication Data

US 2007/0242004 A1 Oct. 18, 2007

(30) Foreign Application Priority Data

Apr. 12, 2006 (JP) ..... 2006-109594

(51) Int. Cl.

| | |
|---|---|
| ***G09G 3/30*** | (2006.01) |
| ***G09G 3/20*** | (2006.01) |
| ***G09G 3/28*** | (2006.01) |
| ***G09G 3/10*** | (2006.01) |

(52) U.S. Cl. ..... 345/76; 345/60; 345/55; 315/169.1

(58) Field of Classification Search ..... 345/30–103
See application file for complete search history.

(56) References Cited

U.S. PATENT DOCUMENTS 6,771,028 B1 * 8/2004 Winters ..... 315/169.1
2003/0067424 A1 * 4/2003 Akimoto et al. ..... 345/55

FOREIGN PATENT DOCUMENTS

JP 2003-122301 4/2003

* cited by examiner

*Primary Examiner*—Sumati Lefkowitz
*Assistant Examiner*—Charles Hicks
(74) *Attorney, Agent, or Firm*—Antonelli, Terry, Stout & Kraus, LLP.

(57) ABSTRACT

An organic electroluminescence (EL) display device wherein pixel defects are reduced with a minimum increase in the number of thin film transistors used is to be provided. The organic EL display device has: a plurality of power supply lines each for supplying a current to one or another of pixel circuits disposed in an area surrounded by image signal lines and scanning lines; a plurality of split organic EL elements connected in parallel, each connected to one or another of the pixel circuits; a first thin film transistor of which the gate electrode is connected to the signal lines, the source electrode is connected in parallel to the anodes of the plurality of split organic EL elements, and the drain is connected to the power supply lines, and which controls the total amperage to be supplied during the light emitting period to the plurality of split organic EL elements with signals captured from the signal lines; and a plurality of second thin film transistors each disposed between the first thin film transistor and one or another of the split organic EL elements to control the current supplied to each of the split organic EL elements from the first thin film transistor.

11 Claims, 6 Drawing Sheets

ORGANIC ELECTROLUMINESCENCE DISPLAY DEVICE

CLAIM OF PRIORITY

The present application claims priority from Japanese Application JP 2006-109594 filed on Apr. 12, 2006, the content of which is hereby incorporated by reference into this application.

BACKGROUND OF THE INVENTION (1) Field of the Invention

The present invention relates to an organic electroluminescence (EL) display device, and more particularly to a technique suitable for obtaining satisfactory images even in the presence of pixels poor in light emitting efficiency, such as defective pixels occurring on the leak path of the organic EL layer due to the invasion of foreign matter or the like.

(2) Description of the Related Art

Flat panel type display devices already in practical use or under research for commercialization include liquid crystal displays (LCD), plasma display panels (PDP), field emission displays (FED) and organic EL displays (OLED). Of these display devices, organic EL displays are very promising display devices as typical thin, light-weight self light-emitting display devices. There are two different types of organic EL display devices, including the so-called bottom emission type and top emission type. Incidentally, though the invention will be described below with reference to an active matrix type organic EL display device, its light emitting structure can also be applied to other organic EL display devices including the simple matrix type.

In an organic EL display device, organic EL light emitting layers, each of which emits light in a prescribed color, are stacked over one (lower electrode) of electrodes formed for each pixel over the inner face of an insulating substrate, such as a glass substrate, and the other electrode (upper electrode) is formed over that lower electrode. By applying a voltage between the lower electrode and the upper electrode to inject holes and carriers into the organic EL light emitting layers, the pixels are caused to emit lights of prescribed frequencies. These pixels are two-dimensionally arranged to display an image. Such a display device is disclosed in Japanese Patent Application Laid-Open Publication No. 2003-122301 for instance. Japanese Patent Application Laid-Open Publication No. 2003-122301 discloses an organic EL display device which is provided with satisfactory moving picture displaying characteristics by controlling the luminescence per frame of the image with display data.

FIGS. 5A and 5B illustrate a one-pixel driving circuit of the organic EL display device according to the related art cited above. FIG. 5A is a diagram of the one pixel circuit, and FIG. 5B illustrates the electrode of an organic EL element (OLED). In FIG. 5A, DTL denotes a signal line; RSL, a reset line (scanning line); PWL, a power supply line; and SWL, a light on/off switching signal line. The gate electrode of a first thin film transistor TFT1 is connected to the signal line DTL via a pixel capacitance CAP. The drain electrode of the first thin film transistor TFT1, also referred to as the drive transistor, is connected to the power supply line PWL and its source electrode, to a first electrode of the organic EL element OLED through the drain-source of a second thin film transistor TFT2.

A third thin film transistor TFT3, connected between the connection point between the first thin film transistor TFT1 and the pixel capacitance CAP and the drain electrode of the first thin film transistor TFT1, discharges the accumulated electric charge of the pixel capacitance CAP at the end of one frame period to prepare for the next signal.

The electrode configuration of the organic EL element shown in FIG. 5A is shown in FIG. 5B. The organic EL element is a diode, and a first electrode BEL is an anode for instance, also referred to as the lower electrode (pixel electrode). A second electrode UEL is a cathode for instance, also referred to as the upper electrode (beta electrode). An organic EL light emitting layer is disposed between these first electrode BEL and second electrode UEL.

FIGS. 6A to 6C illustrate a pixel defect that will arise when a leak occurs in a pixel in the organic EL display device of the configuration shown in FIGS. 5A and 5B. FIG. 6A is an enlarged view of the driving circuit for the one pixel shown in FIGS. 5A and 5B, and FIG. 6B is an enlarged view of a pixel part PXC surrounded by broken lines in FIG. 6A. The lower electrode for the pixel is driven by a second thin film transistor TFT2. FIG. 6C shows a state in which a leak path is formed between the lower electrode and the upper electrode and the whole face of the pixel has become unable to emit light (black point defect).

SUMMARY OF THE INVENTION

In an organic EL light emitting layer, the presence of foreign matter prevents light emission. This is a phenomenon in which foreign matter invades between the electrodes of a pixel to form a leak path of electric current to make it impossible for the whole pixel to emit light. When an organic EL layer is to be formed by using a mask as the thin film transistor substrate (TFT substrate), it is impossible to completely shut out the invasion of foreign matter. Since the area where a leak path is actually formed is only a part of the pixel, the pixel defect can be expected to become less serious by splitting one pixel into a plurality of sub-pixels and causing the leak-free remaining sub-pixels to normally emit light. However, a mere reduction in pixel size would make the device as much more susceptible to defects attributable to the area in which the pixel circuit is formed or to the pixel circuit as the number of pixel circuit splits.

An object of the present invention is to provide an organic EL display device wherein pixel defects are reduced with a minimum increase in the number of thin film transistors used.

The organic EL display device according to the invention has a plurality of first electrodes formed over the main face of an insulating substrate each for a unit pixel, a plurality of organic EL layers each stacked over the first electrodes and emitting light of a different color from others, and a second electrode formed to commonly cover the plurality of organic EL layers.

To achieve the object stated above, the invention provides an organic EL display device having a plurality of signal lines and a plurality of scanning lines arranged crossing each other, a plurality of power supply lines for supplying a current to each of pixel circuits disposed in a pixel area surrounded by the signal lines and the scanning lines, and a plurality of split organic EL elements connected in parallel, each connected to one or another of the pixel circuits, The organic EL display device further has a first thin film transistor of which the gate electrode is connected to the signal lines, the source electrode is connected to the first electrodes of the plurality of split organic EL elements, and the drain is connected to the power supply lines, and which controls the total amperage to be supplied during the light emitting period to the plurality of split organic EL elements with signals captured from the signal lines, and The organic EL display device further has a plurality of second thin film transistors each disposed between the first thin film transistor and one or another of the split organic EL elements to control the current supplied to each of the split organic EL elements from the first thin film transistor.

The invention can be applied to an organic EL display device of an R-G-B system including pixels of red (R), green (G) and blue (B), an R-G-B-W system with pixels of white (W) added to the three, a system of pixels of white (W) alone and other systems.

By splitting one pixel into a plurality of parts, even if a leak path is formed in any of the split organic EL elements, other split organic EL elements can continue light emission (remain active). Therefore, no black point defect occurs though the luminance decreases as much as the area of the split organic EL element in which the leak path has been formed. As a result, the yield of acceptable products rises and the manufacturing cost is reduced.

BRIEF DESCRIPTION OF THE DRAWINGS

These and other features, objects and advantages of the present invention will become more apparent from the following description when taken in conjunction with the accompanying drawings wherein.

DETAILED DESCRIPTION OF THE PREFERRED EMBODIMENTS

A preferred embodiment of the invention will be described in detail below with reference to the accompanying drawings thereof.

Embodiment

Figure 1:
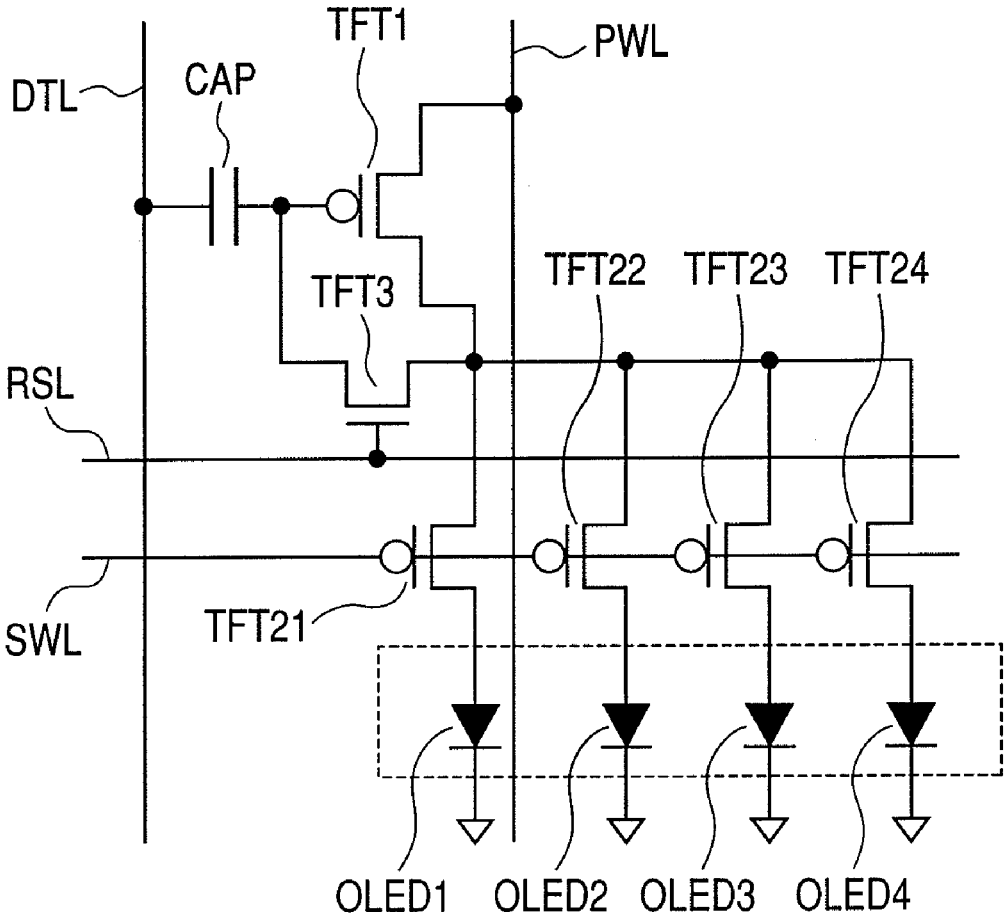
FIG. 1 shows a one-pixel driving circuit in an organic EL display device, which is an embodiment of the present invention.

FIG. 1 shows a one-pixel driving circuit in an organic EL display device, which is an embodiment of the invention. In FIG. 1, DTL denotes a signal line; RSL, a reset line (scanning line); PWL, a power supply line; and SWL, a light on/off switching signal line. The gate electrode of a first thin film transistor TFT1 is connected to the signal line DTL via a pixel capacitance CAP. A first electrode (lower electrode, which is an anode) of one pixel is split into four, and the resultant split organic EL elements OLED1, OLED2, OLED3 and OLED4 are connected in parallel to a first thin film transistor TFT1. Neither the organic EL light emitting layer nor a second electrode (upper electrode, which is a cathode) is not split.

The first thin film transistor TFT1 is a drive transistor, of which the drain electrode is connected to the power supply line PWL and the source electrode, to the split organic EL elements OLED1, OLED2, OLED3 and OLED4 of the first electrode via the drain-source of a second thin film transistor TFT2.

A third thin film transistor TFT3, connected between the connection point between a pixel capacitance CAP and the first thin film transistor TFT1 and the drain electrode of the first thin film transistor TFT1, discharges the accumulated electric charge of the pixel capacitance CAP at the end of one frame period to prepare for the next signal.

In this embodiment, second thin film transistors TFT21, TFT22, TFT23 and TFT24 are arranged intervening between the first thin film transistor TFT1 and the split organic EL elements OLED1, OLED2, OLED3 and OLED4, respectively. The gate electrodes of the second thin film transistors TFT21, TFT22, TFT23 and TFT24 are connected in common to a light on/off switching signal line SWL. The number of the increased transistors is the same as the number of anode splits.

Figure 2A:
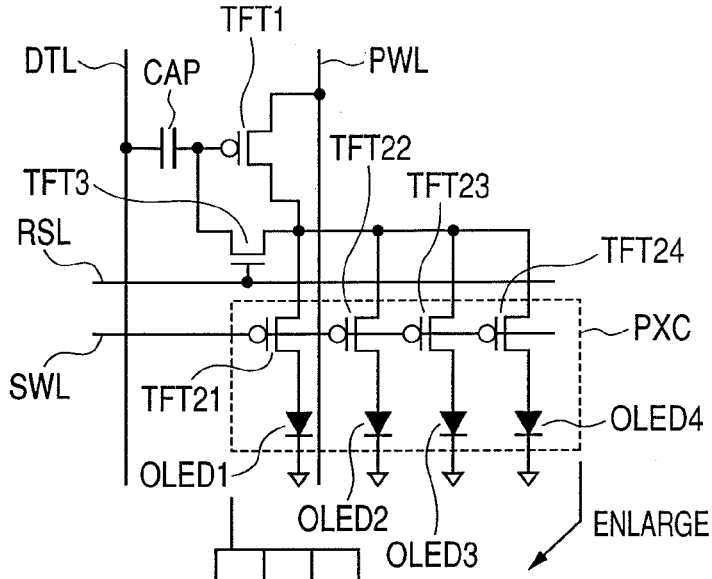
FIGS. 2A to 2C illustrate a pixel defect occurring when any leak path has been formed in the organic EL display device shown in FIG. 1.
Figure 2B:
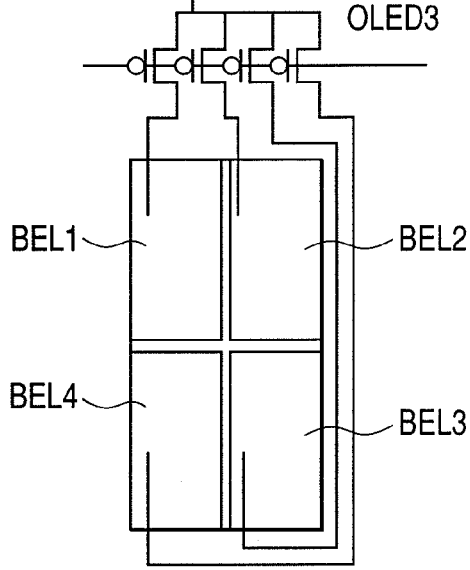
Figure 2C:
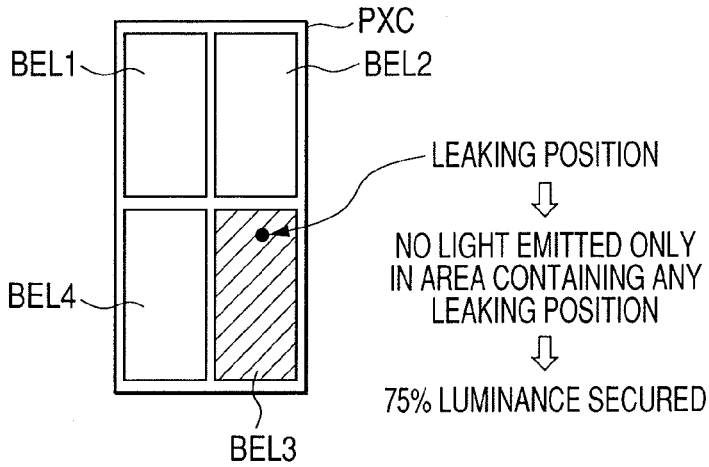

FIGS. 2A to 2C illustrate a pixel defect occurring when any leak path is formed in the organic EL display device shown in FIG. 1. FIG. 2A shows the one-pixel driving circuit shown in FIG. 1, and FIG. 2B is an enlarged view of a pixel part PXC surrounded by broken lines in FIG. 2A. The quadrisected lower electrodes BEL1, BEL2, BEL3 and BEL4 in the pixel are simultaneously driven by the first thin film transistor TFT1. FIG. 2C shows the display state of the pixel in which a leak path is formed between the lower electrodes BEL1, BEL2, BEL3 and BEL4 and the upper electrode.

It is supposed here a case in which a leak path is formed in the area of BEL3 out of the lower electrodes BEL1, BEL2, BEL3 and BEL4 of the four split organic EL elements constituting one pixel. In this case, the split organic EL element configured in the area of the lower electrode 3 does not emit light. However, since the areas of the other split organic EL elements normally emit light, this pixel secures 75% brightness (luminance). Incidentally, since the on-resistances of the second thin film transistors TFT 21, 22, 23 and 24 are sufficiently higher than the resistances of the organic EL light emitting layer, there is no current concentration on the split organic EL element in which the leak path is formed, but the current is distributed to the remaining normal split organic EL elements.

The embodiment can provide an organic EL display device whose pixel defects are reduced with a minimum increase in the number of thin film transistors used. The number of pixel splits is not limited to the four in the above-described embodiment, but two or more splits can remedy almost any pixel defect (black point defect).

Figure 3A:
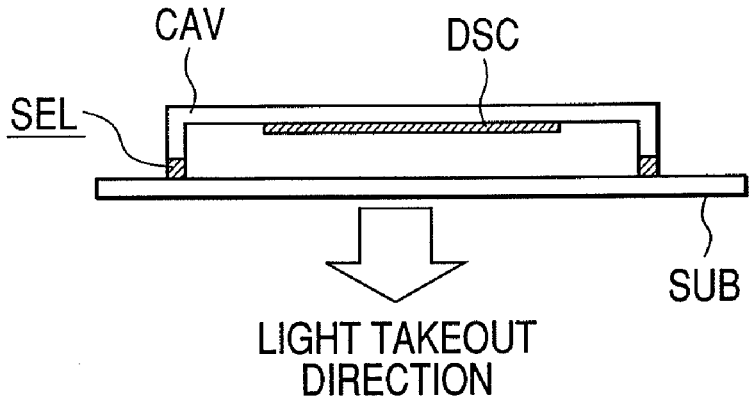
FIGS. 3A and 3B illustrate examples of configuration of a bottom emission type organic EL display device.
Figure 3B:
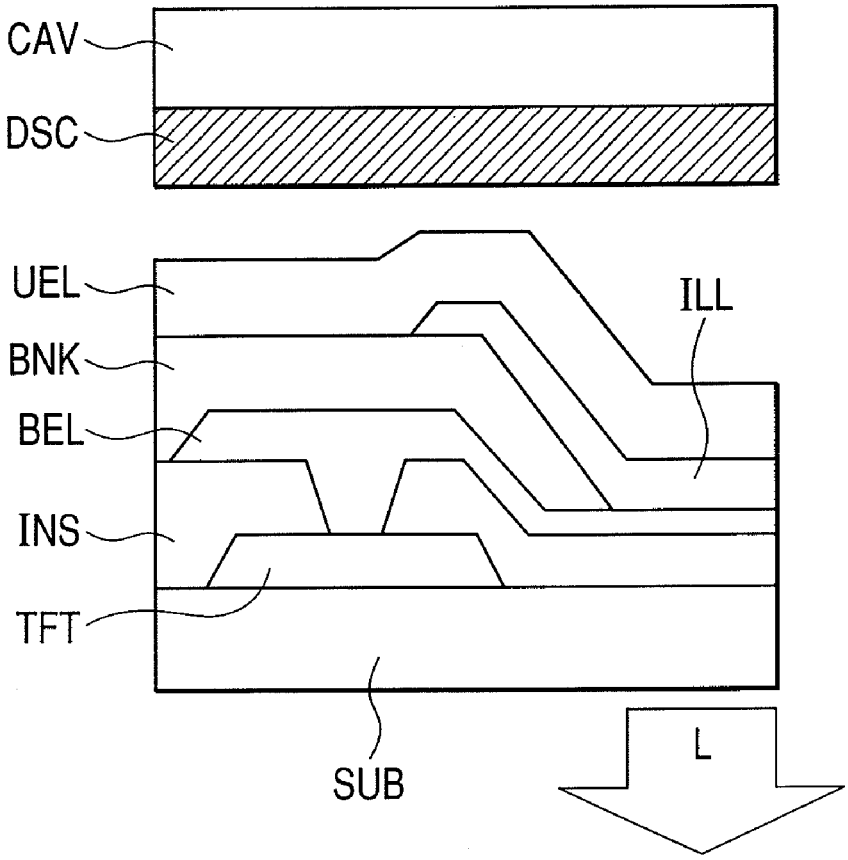

FIGS. 3A and 3B illustrate an example of configuration of a bottom emission type organic EL display device. FIG. 3A is a sectional view schematically illustrating the overall configuration, and FIG. 3B is a sectional view illustrating an exemplary structure of the unit pixel. The bottom emission type organic EL display device has a thin film transistor TFT over an insulating substrate SUB, for which a glass substrate is suitable, a first electrode or one electrode (hereinafter referred to as the lower electrode or a transparent electrode (ITO or the like) as the pixel electrode) BEL is formed through a contact hole bored in an insulating film INS. The lower electrode BEL is split into unit pixels, each constituting an independent split organic EL element.

A bank BNK formed of an insulator is disposed over the formation area of the thin film transistor TFT, and constitutes an accommodating part for an organic EL light emitting layer ILL, which emits light when an electric field is applied to it, by serving as partitioning between adjacent unit pixels. A reflective metal electrode as a second electrode (common electrode) or the other electrode, namely the upper electrode, is formed covering the organic EL light emitting layer ILL. The insulating substrate SUB having on its main face the organic EL element configured in this way is isolated from the external atmosphere by a sealing can CAV, and sealed with a sealing material, such as an adhesive. Incidentally, within the interior sealed by the sealing can CAV, a drying agent or a hygroscopic agent DSC is held.

Then, carriers (electrons and holes) are implanted into the organic EL element, configured of an organic multilayered film, to cause the organic multilayered film to emit light by applying an electric between the lower electrode BEL and the upper electrode UEL, which respectively may be the anode and the cathode, for instance. The luminescence (L) from the organic EL element is emitted through the insulating substrate SUB. The unit pixels of this organic EL element are color pixels of red (R), green (G) and blue (B), and full color image displaying is achieved by arranging these color pixels.

Figure 4A:
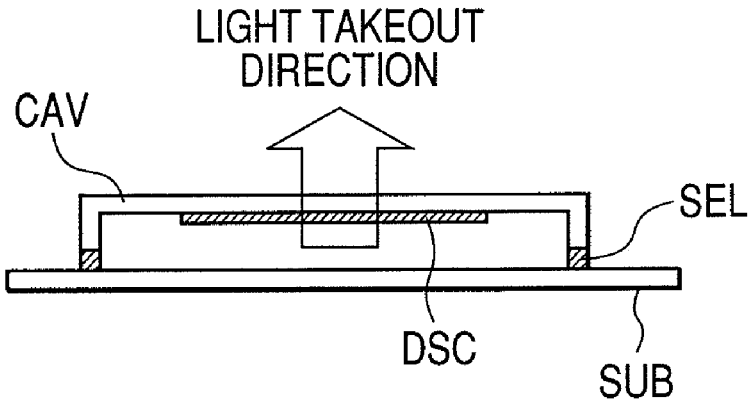
FIGS. 4A and 4B illustrate examples of configuration of a top emission type organic EL display device.
Figure 4B:
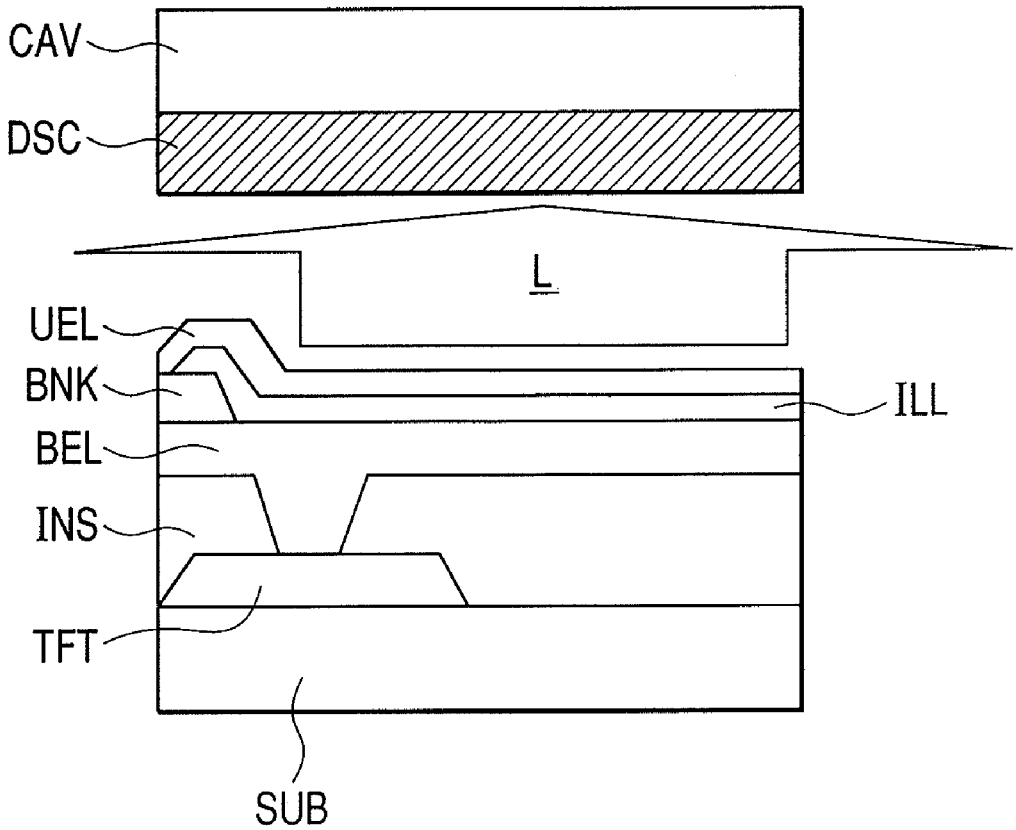
Figure 5A:
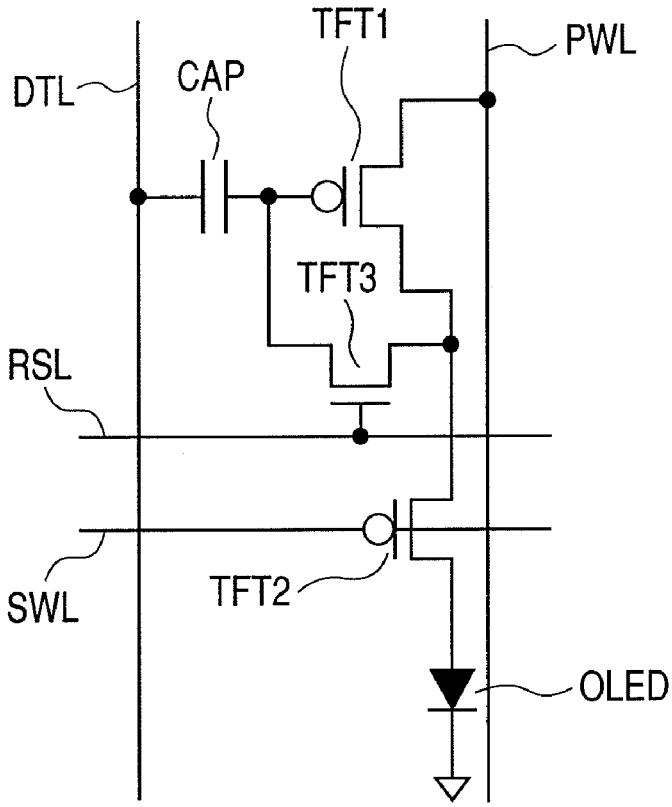
FIGS. 5A and 5B illustrate a one-pixel driving circuit of the organic EL display device according to the earlier cited related art.
Figure 5B:
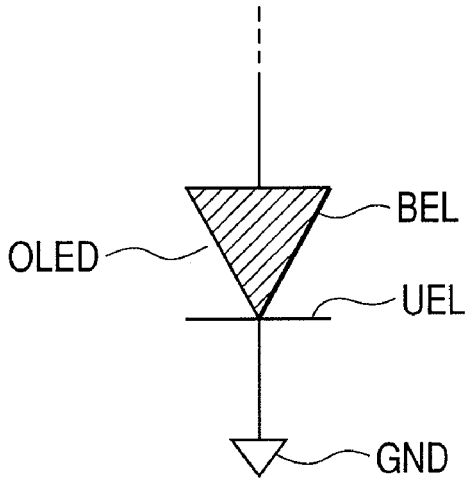
Figure 6A:
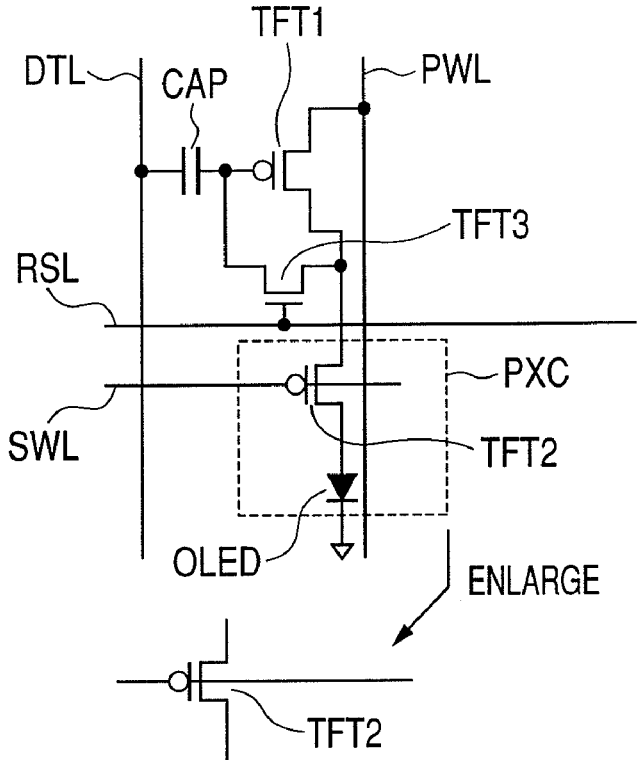
FIGS. 6A to 6C illustrate a pixel defect that will arise when a leak occurs in a pixel in the organic EL display device of the configuration shown in FIGS. 5A and 5B.
Figure 6B:
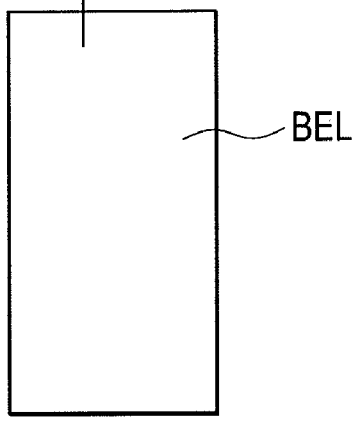
Figure 6C:
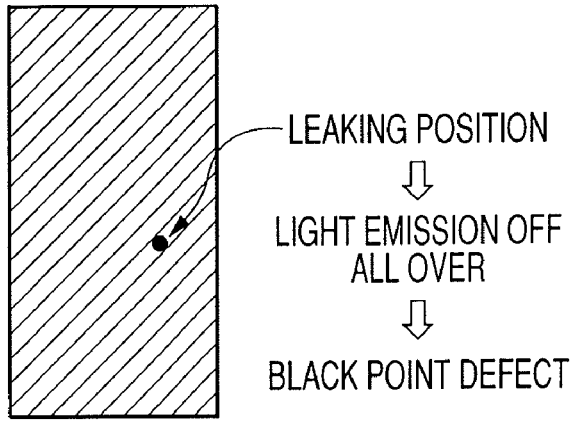

FIGS. 4A and 4B illustrate examples of configuration of a top emission type organic EL display device. FIG. 4A is a sectional view schematically illustrating the overall configuration, and FIG. 4B is a sectional view illustrating an exemplary structure of the unit pixel. In the top emission type organic EL display device, a reflective metal electrode is used as the lower electrode BEL which corresponds to one electrode in the bottom emission type described above, and a transparent electrode such as ITO is used as the upper electrode UEL, the counterpart of the other electrode. By applying an electric field between the two electrodes, an organic multilayered film is caused to emit light, and this luminescence L is emitted from the upper electrode UEL side. The lower electrode BEL in each unit pixel is split to constitute an independent split organic EL element. In the top emission type, a transparent plate, which suitably is a glass plate, is used as the counterpart of the sealing can in the bottom emission type, and a transparent material is used as the drying agent or the hygroscopic agent DSC, which, if not transparent, is arranged where it would not intercept display light. Other aspects of the configuration are substantially the same as their counterparts in FIG. 3.

What is claimed is:

1. An organic electroluminescence display device including a plurality of organic electroluminescence elements, wherein the organic electroluminescence elements are arranged in an area surrounded by image signal lines and scanning lines, have a first thin film transistor, a light emitting unit split into a plurality of light emitting subunits and a plurality of second thin film transistors;

wherein the plurality of light emitting subunits resulting from the splitting are driven by the first thin film transistor; and wherein the plurality of light emitting subunits resulting from the splitting are connected to the plurality of second thin film transistors;

wherein the first transistor for driving the plurality of light emitting subunits is provided with display data through one image signal line;

wherein the plurality of second thin film transistors are connected in parallel;

wherein the first thin film transistor and the plurality of second thin film transistors are connected in series; and wherein the plurality of light emitting subunits emit light of a same color.

2. The organic electroluminescence display device according to claim 1, wherein the gates of the plurality of second thin film transistors are connected to a common signal line.

3. The organic electroluminescence display device according to claim 1, wherein a third thin film transistor is formed between the source or drain electrode of the first thin film transistor and the gate of the first thin film transistor; and wherein the gate of the third thin film transistor is connected to the scanning lines.

4. The organic electroluminescence display device according to claim 1, wherein a capacitance is connected to the gate of the first thin film transistor and the other end of the capacitance is connected to the image signal lines.

5. The organic electroluminescence display device according to claim 1, wherein the light emitting unit is split into four light emitting subunits.

6. An organic electroluminescence display device including a plurality of organic electroluminescence elements, wherein the organic electroluminescence elements are arranged in an area surrounded by image signal lines and scanning lines, have a first thin film transistor, a light emitting unit split into a plurality of light emitting subunits and a plurality of second thin film transistors;

wherein the light emitting unit split into a plurality of light emitting subunits includes an upper electrode, a lower electrode and a plurality of organic electroluminescence films formed between the upper electrode and the lower electrode;

wherein each of the plurality of light emitting subunits resulting from the splitting matches one of the second thin film transistors;

wherein the first transistor is provided with display data through one image signal line;

wherein the plurality of second thin film transistors are connected in parallel;

wherein the first thin film transistor and the plurality of second thin film transistors are connected in series; and wherein the plurality of light emitting subunits emits light of a same color.

7. The organic electroluminescence display device according to claim 6, wherein a power supply line which supplies a current to the light emitting unit is connected to the source electrode of the first thin film transistor;

wherein the source electrode of each of the plurality of second thin film transistors is connected to the drain electrode of the first thin film transistor; and wherein the drain electrode of each of the plurality of second thin film transistors is connected to the split light emitting subunits.

8. The organic electroluminescence display device according to claim 6, wherein the gates of the plurality of second thin film transistors are connected to a common signal line.

9. The organic electroluminescence display device according to claim 6, wherein a third thin film transistor is formed between the drain electrode of the first thin film transistor and the gate electrode of the first thin film transistor; and wherein the gate electrode of the third thin film transistor is connected to the scanning lines.

10. The organic electroluminescence display device according to claim 6, wherein a capacitance is connected to the gate electrode of the first thin film transistor and the other end of the capacitance is connected to the image signal lines.

11. The organic electroluminescence display device according to claim 6, wherein the light emitting unit is split into four light emitting subunits.

* * * * *